US012529005B2

(12) United States Patent
Sawairi et al.

(10) Patent No.: US 12,529,005 B2
(45) Date of Patent: Jan. 20, 2026

(54) LUBRICATING OIL COMPOSITIONS FOR ELECTRIC VEHICLES

(71) Applicant: CHEVRON JAPAN LTD., Tokyo (JP)

(72) Inventors: Ryota Sawairi, Omaezaki (JP); Seiya Shimizu, Makinohara (JP); Masami Fuchi, Makinohara (JP); Takahiro Nakagawa, Omaezaki (JP); Satoshi Ohta, Matsudo (JP); Koichi Kubo, Yokohama (JP); Ataru Minami, Omaezaki (JP)

(73) Assignee: Chevron Japan Ltd., Tokyo (JP)

( * ) Notice: Subject to any disclaimer, the term of this patent is extended or adjusted under 35 U.S.C. 154(b) by 0 days.

(21) Appl. No.: 18/710,170

(22) PCT Filed: Oct. 31, 2022

(86) PCT No.: PCT/IB2022/060449

§ 371 (c)(1),
(2) Date: May 14, 2024

(87) PCT Pub. No.: WO2023/089427

PCT Pub. Date: May 25, 2023

(65) Prior Publication Data

US 2025/0109350 A1 Apr. 3, 2025

Related U.S. Application Data

(60) Provisional application No. 63/280,007, filed on Nov. 16, 2021.

(51) Int. Cl.

| | |
|---|---|
| ***C10M 141/10*** | (2006.01) |
| ***C10M 101/00*** | (2006.01) |
| ***C10M 135/22*** | (2006.01) |
| ***C10M 151/02*** | (2006.01) |
| *C10N 20/02* | (2006.01) |
| *C10N 30/04* | (2006.01) |
| *C10N 30/06* | (2006.01) |
| *C10N 30/10* | (2006.01) |
| *C10N 30/12* | (2006.01) |
| *C10N 40/04* | (2006.01) |

(52) U.S. Cl.

CPC ..... *C10M 141/10* (2013.01); *C10M 101/00* (2013.01); *C10M 135/22* (2013.01); *C10M 151/02* (2013.01); *C10N 2020/02* (2013.01); *C10N 2030/04* (2013.01); *C10N 2030/06* (2013.01); *C10N 2030/10* (2013.01); *C10N 2030/12* (2013.01); *C10N 2040/04* (2013.01)

(58) Field of Classification Search

CPC ..... C10M 141/10; C10M 101/00; C10M 135/22; C10M 151/02; C10N 2020/02; C10N 2030/04; C10N 2030/06; C10N 2030/10; C10N 2030/12; C10N 2040/04

USPC ..... 508/449

See application file for complete search history.

(56) References Cited

U.S. PATENT DOCUMENTS

| | | | | |
|---|---|---|---|---|
| 11,788,026 | B2 * | 10/2023 | Dyer | C10M 137/105 508/281 |
| 2005/0153850 | A1 * | 7/2005 | Nelson | C08F 8/34 549/36 |
| 2008/0194442 | A1 | 8/2008 | Watts | |
| 2012/0277134 | A1 * | 11/2012 | Deshimaru | C10M 141/10 508/440 |
| 2015/0038385 | A1 * | 2/2015 | Barton | C10M 141/08 508/415 |

OTHER PUBLICATIONS

PCT International Search Report mailed on Mar. 17, 2023, issued in International Application No. PCT/IB2022/060449, filed on Oct. 31, 2022, 03 pages.

* cited by examiner

*Primary Examiner* — Prem C Singh
*Assistant Examiner* — Francis C Campanell

(57) ABSTRACT

A lubricating oil composition for an automotive vehicle with an electric motor and/or generator is provided. The lubricating oil composition includes: a. a major amount of an oil of lubricating viscosity having a kinematic viscosity at 100° C. in a range of about 1.5 $mm^2/s$ to about 20 $mm^2/s$; b. an sulfur-based additive including a thiadiazole and a sulfurized polyolefin of formula (I):

(I)

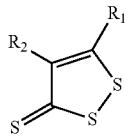

where $R_1$ is hydrogen or methyl, and $R_2$ is a C8-C40 hydrocarbyl group, the sulfur-based additive providing sulfur to the lubricating oil composition in an amount of 0.01 wt. % to 0.2 wt. %, based on the total weight of the lubricating oil composition; c. a phosphorus compound; and d. an ashless polyisobutenyl succinimide-based dispersant containing boron. The lubricating oil composition provides exceptional volume resistivity, detergency, thermal and oxidative stability, wear resistance, and corrosion resistance at high temperatures.

21 Claims, No Drawings

LUBRICATING OIL COMPOSITIONS FOR ELECTRIC VEHICLES

CROSS-REFERENCE TO RELATED APPLICATION

This application claims the benefit of U.S. Provisional Patent Application No. 63/280,007, filed Nov. 16, 2021, which is incorporated by reference herein in its entirety.

FIELD

The present disclosure generally relates to a lubricating oil composition for automotive transmissions, and particularly transmissions of electric vehicles (EV), such as e-axle and hybrid vehicles (HV).

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electric vehicles (EV), including battery electric vehicles (BEVs), hybrid vehicles (HVs), and plug-in hybrid vehicles (PHVs), with electric motors and/or generators built into the drivetrain present a unique challenge for the lubrication industry.

One challenge in electric vehicles and hybrid vehicles is wear protection. Unlike a traditional vehicle powered by an internal combustion engine, in an electric vehicle, the same lubricating fluid is shared by the electric motor and the transmission. The planetary gears used in the transmission system of electric vehicles and hybrid vehicles can present challenges with regard to wear protection. While phosphorus- and sulfur-based additives can provide wear protection, sulfur compounds can oxidize to acidic species at high temperatures and contribute to increased corrosion. This is especially detrimental in an electric vehicle or hybrid vehicle, where copper is present in many of the electric systems of the powertrain and may become corroded at high temperatures. The lubricant used in lubrication of these vehicles, therefore, may provide sufficient copper corrosion protection to minimize corrosion.

Furthermore, electromagnets used to operate the motor cause copper loss (loss due to the electrical resistance of the copper wire in the motor), which causes heat to be generated in the enamel wire (magnetic wire) in the motor. In the case of an electric vehicle, the lubricating oil used for the transmission is directly sprayed onto the enamel wire to cool it (oil cooling). While this oil cooling has very good cooling efficiency, the oil comes into direct contact with the surface of the high temperature enamel wire, so if a highly reactive extreme pressure agent is used in the lubricating oil, a high temperature deposit may be formed. The deposit can build up around the enamel wire, reducing cooling efficiency and causing damage.

The volume resistivity (resistance of the fluid to electrical current) can also be an issue. When resistivity is too low, the powertrain may leak charge and lose efficiency. When it is too high, buildup of electrostatic charge can result in arcing in the electrified components of the vehicle. The presence of metal ions decreases the volume resistivity of a fluid. Metals commonly used in lubricants for traditional internal combustion engines, such as Ca, Mo, and Zn, may therefore be minimized in electrical vehicles to meet the volume resistivity requirements.

Given the complexities associated with lubrication of electric vehicles and hybrid vehicles, there exists a need for a lubricant that balances wear protection with good copper corrosion resistance, sufficient volume resistivity, and good hot surface deposit control.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The disclosed embodiments relate to a lubricating oil composition suitable for use in automotive transmissions, particularly those of electric vehicles and hybrid vehicles. The lubricating oil composition demonstrates high wear protection, good copper corrosion resistance, sufficient volume resistivity, and good hot surface deposit control.

In accordance with one embodiment of the present disclosure, a lubricating oil composition for an automotive vehicle with an electric motor and/or generator is provided. The lubricating oil composition includes:

a. a major amount of an oil of lubricating viscosity having a kinematic viscosity at 100° C. in a range of about 1.5 $mm^2/s$ to about 20 $mm^2/s$;

b. a sulfur-based additive including a thiadiazole and a sulfurized polyolefin of formula (I):

(I)

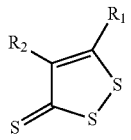

where $R_1$ is hydrogen or methyl, and $R_2$ is a C8-C40 hydrocarbyl group, the sulfur-based additive providing sulfur to the lubricating oil composition in an amount of 0.01 wt. % to 0.2 wt. %, based on the total weight of the lubricating oil composition;

c. a phosphorus compound; and d. an ashless polyisobutenyl succinimide-based dispersant containing boron.

In accordance with another embodiment of the present disclosure, a method of reducing corrosion and improving wear protection in the transmission system of an automotive vehicle with an electric motor and/or generator by lubricating the transmission system with a lubricating oil composition is provided. The lubricating oil composition includes:

a. a major amount of an oil of lubricating viscosity having a kinematic viscosity at 100° C. in a range of about 1.5 $mm^2/s$ to about 20 $mm^2/s$;

b. an sulfur-based additive including a thiadiazole and a sulfurized polyolefin of formula (I):

(I)

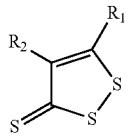

where $R_1$ is hydrogen or methyl, and $R_2$ is a C8-C40 hydrocarbyl group, the sulfur-based additive providing sulfur to the lubricating oil composition in an amount of 0.01 wt. % to 0.2 wt. %, based on the total weight of the lubricating oil composition;

c. a phosphorus compound; and d. an ashless polyisobutenyl succinimide-based dispersant containing boron.

DETAILED DESCRIPTION

As set forth above, unlike a traditional vehicle powered by an internal combustion engine, in an electric vehicle, the same lubricating fluid is shared by the electric motor and the transmission. This presents unique challenges for lubricating the transmission of these types of vehicles. One particular challenge faced by the lubrication industry is that certain lubricant additives may be useful for wear and seizure protection, but over time can contribute to increased corrosion.

As an example, when a lubricating oil is new, corrosion of non-ferrous metals, especially copper, by extreme pressure (EP) and anti-wear agents (which generate acidic degradation products) is prevented by the effect of a corrosion inhibitor. However, as the lubricating oil is used over time, the oil deteriorates and the corrosion inhibitor is consumed. This allows increased rates of corrosion of the non-ferrous metals due to oxidative degradation products from EP and anti-wear additives.

As described in detail herein, the present inventors have found a particular combination of lubricating oil components useful in the lubrication of EV and hybrid vehicle transmissions that allow the use of the lubricating oil over an extended period of time. The lubricating oil exhibits good thermal and oxidation stability, and also has reduced corrosion rates of non-ferrous metals even when the oil deteriorates and the corrosion inhibitor becomes consumed.

Definitions

The following terms will be used throughout the specification and will have the following meanings unless otherwise indicated.

The term "major amount" of a base oil refers to an amount of the base oil that is at least 40 wt. % of the lubricating oil composition. In some embodiments, "a major amount" of the base oil refers to an amount of the base oil that is more than 50 wt. %, more than 60 wt. %, more than 70 wt. %, more than 80 wt. %, or more than 90 wt. % of the lubricating oil composition.

The term "minor amount" of an additive refers to an amount of the additive that is not greater than 40 wt. % of the lubricating oil composition. In some embodiments, "a minor amount" of the additive refers to an amount of the additive that is not greater than 40 wt. %, not greater than 30 wt. %, or not greater than 20 wt. % of the lubricating oil composition.

The term "substantially free" of metals refers a level of metals that is present at 50 ppm or less than 50 ppm in the lubricating oil composition.

The term "ashless" with regard to an additive of the lubricating oil composition means that the additive does not contain a metal.

The term "Total Base Number" or "TBN" refers to the level of alkalinity in a lubricating oil sample, which indicates the ability of the lubricating oil composition to continue to neutralize corrosive acids, in accordance with ASTM Standard No. D2896 or equivalent procedure. The test measures the change in electrical conductivity, and the results are expressed as mgKOH/g (the equivalent number of milligrams of KOH needed to neutralize 1 gram of a product). Therefore, a high TBN reflects strongly overbased products and, as a result, a higher base reserve for neutralizing acids.

The term "PIB" refers to polyisobutylene.

The Oil of Lubricating Viscosity

The lubricating oil compositions disclosed herein generally include at least one oil of lubricating viscosity. Any base oil known to a skilled artisan can be used as the oil of lubricating viscosity disclosed herein. Some base oils suitable for preparing the lubricating oil compositions have been described in Mortier et al., "*Chemistry and Technology of Lubricants,*" 2nd Edition, London, Springer, Chapters 1 and 2 (1996); A. Sequeria, Jr., "*Lubricant Base Oil and Wax Processing*," New York, Marcel Decker, Chapter 6, (1994); and D. V. Brock, *Lubrication Engineering*, Vol. 43, pages 184-5, (1987), all of which are incorporated herein by reference. Generally, the lubricating oil composition will have a major amount of the base oil in the lubricating oil composition, and in some embodiments may include from about 70 wt. % to about 99.5 wt. % base oil, based on the total weight of the lubricating oil composition. In some embodiments, the amount of the base oil in the lubricating oil composition is from about 40 wt. %, 50 wt. %, 60 wt. %, 70 wt. %, 75 wt. %, 80 wt. %, or 85 wt. % to about 90 wt. %, 98 wt. %, 98.5 wt. %, or 99 wt. %, based on the total weight of the lubricating oil composition.

In certain embodiments, the oil of lubricating viscosity, also referred to as the base oil or base stock, is or includes any natural or synthetic lubricating base oil fraction. Some non-limiting examples of synthetic oils include oils, such as polyalphaolefins or PAOs, prepared from the polymerization of at least one alpha-olefin, such as ethylene, or from hydrocarbon synthesis procedures using carbon monoxide and hydrogen gases, such as the Fisher-Tropsch process. In certain embodiments, the base oil comprises less than about 10 wt. % of one or more heavy fractions, based on the total weight of the base oil. A heavy fraction refers to an oil fraction having a viscosity of at least about 20 cSt at 100° C. In certain embodiments, the heavy fraction has a viscosity of at least about 25 cSt or at least about 30 cSt at 100° C. In further embodiments, the amount of the one or more heavy fractions in the base oil is less than about 10 wt. %, less than about 5 wt. %, less than about 2.5 wt. %, less than about 1 wt. %, or less than about 0.1 wt. %, based on the total weight of the base oil. In still further embodiments, the base oil comprises no heavy fraction.

The lubricating oil compositions typically comprise a major amount of the oil of lubricating viscosity. In some embodiments, the oil of lubricating viscosity has a kinematic viscosity at 100° C. of about 1.5 centistokes (cSt) to about 20 cSt, about 2 cSt to about 20 cSt, or about 2 cSt to about 16 cSt. The kinematic viscosity of the oils of lubricating viscosity disclosed herein can be measured according to ASTM D 445, which is incorporated herein by reference.

In other embodiments, the oil of lubricating viscosity is or comprises a base stock or blend of base stocks. In further embodiments, the base stocks are manufactured using a variety of different processes including, but not limited to, distillation, solvent refining, hydrogen processing, oligomerization, esterification, and rerefining. In some embodiments, the base stocks comprise a rerefined stock. In further embodiments, the rerefined stock shall be substantially free from materials introduced through manufacturing, contamination, or previous use.

In some embodiments, the oil of lubricating viscosity comprises one or more of the base stocks in one or more of Groups I-V as specified in the American Petroleum Institute (API) Publication 1509, Fourteen Edition, December 1996 (i.e., API Base Oil Interchangeability Guidelines for Passenger Car Motor Oils and Diesel Engine Oils), which is incorporated herein by reference. The API guideline defines a base stock as a lubricant component that may be manufactured using a variety of different processes. Groups I, II and III base stocks are mineral oils, each with specific ranges of the saturates content, sulfur content, and viscosity index. Group IV base stocks are polyalphaolefins (PAO). Group V base stocks include all other base stocks not included in Group I, II, III, or IV.

In some embodiments, the oil of lubricating viscosity comprises one or more of the base stocks in Group I, II, III, IV, V or a combination thereof. In other embodiments, the oil of lubricating viscosity comprises one or more of the base stocks in Group II, III, IV or a combination thereof. In certain embodiments, the oil of lubricating viscosity oil has a kinematic viscosity of about 1.5 cSt to about 20 cSt, about 2 cSt to about 20 cSt, or about 2 cSt to about 16 cSt at 100° C. According to example embodiments, the oil of lubricating viscosity comprises a mixture of the Group II base stock and the Group III base stock.

The oil of lubricating viscosity (base oil) may also be selected from the group consisting of natural oils of lubricating viscosity, synthetic oils of lubricating viscosity and mixtures thereof. In some embodiments, the base oil includes base stocks obtained by isomerization of synthetic wax and slack wax, as well as hydrocrackate base stocks produced by hydrocracking (rather than solvent extracting) the aromatic and polar components of the crude. In other embodiments, the oil of lubricating viscosity includes natural oils, such as animal oils, vegetable oils, mineral oils (e.g., liquid petroleum oils and solvent treated or acid-treated mineral oils of the paraffinic, naphthenic or mixed paraffinic-naphthenic types), oils derived from coal or shale, and combinations thereof. Some non-limiting examples of animal oils include bone oil, lanolin, fish oil, lard oil, dolphin oil, seal oil, shark oil, tallow oil, and whale oil. Some non-limiting examples of vegetable oils include castor oil, olive oil, peanut oil, rapeseed oil, corn oil, sesame oil, cottonseed oil, soybean oil, sunflower oil, safflower oil, hemp oil, linseed oil, tung oil, oiticica oil, jojoba oil, and meadow foam oil. Such oils may be partially or fully hydrogenated.

In some embodiments, the synthetic oils of lubricating viscosity include hydrocarbon oils and halo-substituted hydrocarbon oils, such as polymerized and inter-polymerized olefins, alkylbenzenes, alkylated naphthalene, polyphenyls, alkylated diphenyl ethers, alkylated diphenyl sulfides, as well as their derivatives, analogues and homologues thereof, and the like. In other embodiments, the synthetic oils include alkylene oxide polymers, interpolymers, copolymers and derivatives thereof, wherein the terminal hydroxyl groups can be modified by esterification, etherification, and the like. In further embodiments, the synthetic oils include the esters of dicarboxylic acids with a variety of alcohols. In certain embodiments, the synthetic oils include esters made from $C_5$ to $C_{12}$ monocarboxylic acids and polyols and polyol ethers. In further embodiments, the synthetic oils include tri-alkyl phosphate ester oils, such as tri-n-butyl phosphate and tri-iso-butyl phosphate.

In some embodiments, the synthetic oils of lubricating viscosity include silicon-based oils (such as the polyalkyl-, polyaryl-, polyalkoxy-, polyaryloxy-siloxane oils and silicate oils). In other embodiments, the synthetic oils include liquid esters of phosphorus-containing acids, polymeric tetrahydrofurans, polyalphaolefins, and the like.

Base oil derived from the hydroisomerization of wax may also be used, either alone or in combination with the aforesaid natural and/or synthetic base oil. Such wax isomerate oil is produced by the hydroisomerization of natural or synthetic waxes or mixtures thereof over a hydroisomerization catalyst.

In further embodiments, the base oil comprises a poly-alpha-olefin (PAO). In general, the poly-alpha-olefins may be derived from an alpha-olefin having from about 2 to about 30, from about 2 to about 20, or from about 2 to about 16 carbon atoms. Non-limiting examples of suitable poly-alpha-olefins include those derived from octene, decene, mixtures thereof, and the like. These poly-alpha-olefins may have a viscosity of about 1.5 cSt to about 15 cSt, about 1.5 cSt to about 12 cSt, or about 1.5 cSt to about 8 cSt at 100° C. In some instances, the poly-alpha-olefins may be used together with other base oils such as mineral oils.

In further embodiments, the base oil comprises a polyalkylene glycol or a polyalkylene glycol derivative, where the terminal hydroxyl groups of the polyalkylene glycol may be modified by esterification, etherification, acetylation and the like. Non-limiting examples of suitable polyalkylene glycols include polyethylene glycol, polypropylene glycol, polyisopropylene glycol, and combinations thereof. Non-limiting examples of suitable polyalkylene glycol derivatives include ethers of polyalkylene glycols (e.g., methyl ether of polyisopropylene glycol, diphenyl ether of polyethylene glycol, diethyl ether of polypropylene glycol), mono- and polycarboxylic esters of polyalkylene glycols, and combinations thereof. In some instances, the polyalkylene glycol or polyalkylene glycol derivative may be used together with other base oils such as poly-alpha-olefins and mineral oils.

In further embodiments, the base oil may include any of the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, and the like) with a variety of alcohols (e.g., butyl alcohol, hexyl alcohol, dodecyl alcohol, 2-ethylhexyl alcohol, ethylene glycol, diethylene glycol monoether, propylene glycol, and the like). Non-limiting examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the like.

In further embodiments, the base oil may include a hydrocarbon prepared by the Fischer-Tropsch process. The Fischer-Tropsch process prepares hydrocarbons from gases containing hydrogen and carbon monoxide using a Fischer-Tropsch catalyst. These hydrocarbons may require further processing to be useful as base oils. For example, the hydrocarbons may be dewaxed, hydroisomerized, and/or hydrocracked using processes known to a person of ordinary skill in the art.

In further embodiments, the base oil comprises an unrefined oil, a refined oil, a re-refined oil, or a mixture thereof. Unrefined oils are those obtained directly from a natural or synthetic source without further purification treatment. Non-limiting examples of unrefined oils include shale oils obtained directly from retorting operations, petroleum oils obtained directly from primary distillation, and ester oils obtained directly from an esterification process and used without further treatment. Refined oils are similar to the unrefined oils except the former have been further treated by one or more purification processes to improve one or more properties. Many such purification processes are known to those skilled in the art such as solvent extraction, secondary distillation, acid or base extraction, filtration, percolation, and the like. Re-refined oils are obtained by applying to refined oils processes similar to those used to obtain refined oils. Such re-refined oils are also known as reclaimed or reprocessed oils and often are additionally treated by processes directed to removal of spent additives and oil breakdown products.

Sulfur-Based Additives

The lubricating oil composition of the present disclosure includes at least one sulfur-based additive. The sulfur-based additive may include a thiadiazole and/or a sulfurized polyolefin as described below.

In accordance with certain embodiments of this disclosure, the one or more sulfur-based additives of the lubricating oil composition may include a sulfurized polyolefin, for example a sulfurized polyisobutylene (PIB). In one embodiment, the lubricating oil composition includes a sulfurized polyisobutylene oligomer made by reacting highly reactive polyisobutylene (HR PIB) with sulfur. This sulfurized polyisobutylene oligomer has a sulfur content ranging from 15 wt. %, 16 wt. %, 17 wt. %, 18 wt. %, 19 wt. %, or 20 wt. % to 21 wt. %, 22 wt. %, 23 wt. %, 24 wt. %, or 25 wt. %, for example 20.6 wt. %, based on the total weight of the sulfurized polyisobutylene oligomer. Examples of a sulfurized PIB oligomer are described in U.S. Pat. No. 7,414,013, which is incorporated herein by reference in its entirety.

According to particular embodiments, the sulfur-based additive includes a sulfurized polyolefin of formula (I):

(I)

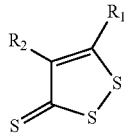

where R1 is hydrogen or methyl, and R2 is a C8-C40 hydrocarbyl group.

By way of non-limiting example, the sulfurized polyolefin of formula (I) may be the following sulfurized polyisobutylene oligomer of formula (II):

(II)

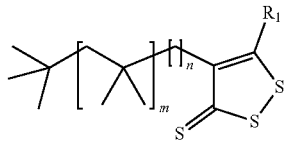

wherein $R_1$ is hydrogen or methyl; m is an integer from 1 to 9; and n is 0 or 1, with the condition that when n is 0 then $R_1$ is methyl, and when n is 1 then $R_1$ is hydrogen. In one embodiment, m is an integer from 1 to 6 such as from 1 to 5 and n is 1. In another aspect, m is greater than one, such as an integer from 2 to 5 and n is 1.

According to certain embodiments of this disclosure, the sulfurized polyolefin of formula (I) is present in the lubricating oil composition in an amount of 0.05 wt. %, 0.1 wt. %, or 0.13 wt. %, to 0.18 wt. %, 0.2 wt. %, 0.25 wt. %, 0.3 wt. %, 0.4 wt. %, 0.5 wt. %, 0.6 wt. %, 0.7 wt. %, or 0.8 wt. %, based on the total weight of the lubricating oil composition. In the lubricating oil embodiments of this disclosure, it has been found that increasing the sulfur content provided by the sulfurized polyolefin of formula (I) can deteriorate the results of high-temperature oxidation stability and anti-corrosion tests. In such embodiments, the sulfurized polyolefin of formula (I) provides the lubricating oil composition with a sulfur content of 0.01 wt. %, 0.02 wt. %, 0.03 wt. %, 0.05 wt. %, 0.06 wt. % up to 0.1 wt. %, or up to 0.2 wt. %, based on the total weight of the lubricating oil composition.

As noted, the sulfur-based additive may include a thiadiazole compound either in addition to or in lieu of the sulfurized polyolefin of formula (I). Indeed, in one embodiment the at least one sulfur-based additive includes both the sulfurized polyolefin of formula (I) and a thiadiazole compound. Thiadiazole compounds in particular provide good resistance to wear between metal-to-metal surfaces. Examples of thiadiazole compounds include 1,3,4-thiadiazoles, 1,2,4-thiadiazoles, and 1,4,5-thiadiazoles. In embodiments where the sulfur-based additive includes a thiadiazole, the thiadiazole may have a sulfur content ranging from 30.0 wt. % to 40.0 wt. %, for example 34.0 wt. %, based on the total weight of the thiadiazole. The thiadiazole may be present, for example, in an amount of 0.005 wt. %, or 0.01 wt. % to 0.03 wt. %, 0.05 wt. %, 0.1 wt. %, 0.2 wt. %, 0.3 wt. %, or 0.5 wt. %, based on the total weight of the lubricating oil composition. The thiadiazole may be used as a corrosion inhibitor in the range of 0.005 wt. % to 0.05 wt. % and may be used up to about 0.5 wt. % to improve anti-wear and EP performance. In some embodiments, a sulfide film is formed on the lubricated surface to prevent corrosion and exhibit anti-wear, but may readily form sludge if too much is used. In accordance with present embodiments, the thiadiazole provides the lubricating oil with a sulfur content of 0.005 wt. % to 0.2 wt. %, based on the total weight of the lubricating oil composition.

In certain embodiments, the thiadiazole compound is a 1,3,4-thiadiazole, such as a 2,5-bis(hydrocarbylmercapto)-1,3,4-thiadiazole as defined by the following formula (III):

(III)

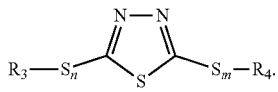

In the structure above, $R_3$ and $R_4$ each represent an alkyl group having 1 to 30 carbon atoms, such as 6 to 18 carbon atoms. The alkyl group may be linear or branched. $R_3$ and $R_4$ may be mutually the same or different. Further, n and m are individually 1 or 2. Specific examples of the alkyl group represented by $R_3$ and $R_4$ in the general structure above include a methyl group, an ethyl group, or any linear (n-), secondary (sec-), terminal branched (iso-), or tertiary (tert-) alkyl group having from 3-30 carbon atoms.

In one embodiment, the sulfur-based additives are present in a total amount of from 0.01 wt. %, 0.05 wt. %, 0.08 wt. %, or 0.09 wt. % up to 0.8 wt. %, 0.75 wt. %, 0.7 wt. %, 0.6 wt. %, or 0.5 wt. %, for example 0.8 wt. %, based on the total weight of the lubricating oil composition. As noted, if the sulfur content of the lubricating oil composition is too high, this may result in deterioration of the results of high-temperature oxidation stability and anti-corrosion tests. Further, if a large amount of the sulfur-containing additive is used, the thermal and oxidation stability will decrease and corrosion will worsen. In particular, elution of copper begins if too much sulfur is introduced into the composition. To realize the benefits of the sulfur-based additives described herein, in accordance with present embodiments the sulfur-based additives provide sulfur to the lubricating oil composition in a total amount of 0.01 wt. %, 0.02 wt. %, 0.03 wt. %, 0.04 wt. %, or 0.05 wt. %, to 0.1 wt. %, 0.15 wt. %, or 0.2 wt. %, based on the total weight of the lubricating oil composition.

The lubricating oil composition may include one or more additional extreme pressure (EP) sulfur-based additives, which can prevent sliding metal surfaces from seizing under conditions of extreme pressure. Generally, the extreme pressure additive is a compound that can combine chemically with a metal to form a surface film that prevents the welding of asperities in opposing metal surfaces under high loads. Examples of the sulfur-based extreme pressure additives include sulfurized oils and fats, sulfurized fatty acids, sulfurized esters, sulfurized olefins, dihydrocarbyl polysulfides, thiophosphoric esters (thiophosphites and thiophosphates), alkylthiocarbamoyl compounds thiocarbamate compounds, thioterpene compounds and dialkylthiodipropionate compounds.

The sulfur-based additives are typically ashless and thus do not contain metal.

Phosphorus Additive

The lubricating oil composition of the present disclosure also includes at least one phosphorus-containing additive, for example one or more phosphorus-containing anti-wear additives.

The at least one phosphorus additive may be an acidic phosphate ester, a phosphate ester, an amine salt of a phosphate ester (amine phosphate), an acidic phosphonate ester, a phosphonate ester, an acidic phosphite ester, a phosphite ester, and phosphoric acid. For example, the phosphorous additive could include acidic or neutral phosphites, acidic or neutral phosphate esters and their amine salts, phosphonate esters, or combinations thereof. According to certain embodiments, the phosphorous additive includes a phosphonate, an amine phosphate, and/or a phosphite ester. The at least one phosphorous additive may be present in an amount ranging from 0.005 wt. %, 0.01 wt. %, 0.03 wt. %, 0.05 wt. %, 0.10 wt. %, or 0.20 wt. % to 0.7 wt. %, 0.6 wt. %, 0.5 wt. %, 0.40 wt. %, 0.35 wt. %, or to 0.33 wt. %, based on the total weight of the lubricating oil composition.

(a) Phosphonates

Phosphonates are a salt or ester of phosphonic acid. They include tetrahedral phosphorus centers and are typically prepared from phosphorus acid.

Phosphonate salts are the result of deprotonation of phosphonic acids, which are diprotic acids:

$$RPO(OH)_2+NaOH \rightarrow H_2O+RPO(OH)(ONa) \text{ (monosodium phosphonate)}$$

$$RPO(OH)(ONa)+NaOH \rightarrow H_2O+RPO(ONa)_2 \text{ (disodium phosphonate)}$$

Phosphonate esters are the result of condensation of phosphonic acids with alcohols and may be acidic or neutral. Neutral phosphonate esters have the formula $R—PO(OR)_2$, while acidic phosphonate esters have the formula $R—PO(OR)_x(OH)_y$, $x+y=2$, and x, y=0, 1 or 2. In the above reaction schema and formulas for the phosphonate esters, R represents a hydrocarbon group having 1 to 30 carbons.

According to an example embodiment, the lubricating oil composition includes an alkyl phosphonate ester commercially available from Solvay Chemicals as Duraphos-100. More specifically this alkyl phosphonate ester is dimethyl octadecyl-phosphonate ($C_{18}H_{37}—P(OCH_3)_2$. This is an alkyl phosphonate ester including 8.5 wt. % phosphorus, based on the total weight of the alkyl phosphonate. In certain embodiments the alkyl phosphonate is present in an amount of 0.20 wt. %, 0.25 wt. %, or 0.27 wt. % to 0.7 wt. %, 0.6 wt. %, 0.5 wt. %, 0.40 wt. %, 0.35 wt. %, or 0.33 wt. %, based on the total weight of the lubricating oil composition.

(b) Phosphates and Phosphate Amines

The phosphorus additive may alternatively or further include a phosphate, a phosphate ester, and/or an amine salt of a phosphate ester. Examples of the phosphate ester amine salt include an amine salt of an acidic alkylphosphate ester, the acidic alkylphosphate ester being represented by the following formula IV:

$$(OR)_x(OH)_yP{=}O \qquad \text{(IV)},$$

wherein $x+y=3$ and R represents an alkyl group having 1 to 30 carbons.

Specific examples of alkyl groups represented by R include a linear or branched alkyl group having 1 to 18, such as 1 to 12 carbon atoms, and examples thereof include a include a methyl group, an ethyl group, or any linear (n-), secondary (sec-), terminal branched (iso-), or tertiary (tert-) alkyl group having from 3-18 carbon atoms.

The amine used to produce the amine salt may be a primary amine, a secondary amine, a tertiary amine, or a tertiary-alkyl primary amine. In addition, examples of the foregoing amine include an amine represented by formula (V):

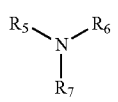

(V)

in which $R_5$, $R_6$, and $R_7$ are aliphatic hydrocarbon groups having 1 to 20 carbon atoms or a hydrogen atom, and at least one of $R_5$, $R_6$, and $R_7$ is an aliphatic hydrocarbon group having 1 to 20 carbon atoms. Here, the aliphatic hydrocarbon group is typically an alkyl group or an unsaturated hydrocarbon group having 1 to 2 unsaturated double bonds, and the alkyl group and the unsaturated hydrocarbon group may be each any of straight-chain, branched, and cyclic groups. The aforementioned aliphatic hydrocarbon group is typically one having 6 to 20 carbon atoms, and more typically one having 12 to 20 carbon atoms. In certain embodiments the amine is a primary amine in which the aliphatic hydrocarbon group has 12 to 20 carbon atoms, for example a tertiary alkyl primary amine as disclosed in WO1995006094, which is incorporated by reference herein in its entirety.

In one embodiment, the phosphate, a phosphate ester, and/or the an amine salt of a phosphate ester is present in a total amount of 0.1 wt. % or 0.2 wt. % to 0.5 wt. %, 0.4 wt. %, or 0.35 wt. %, based on the total weight of the lubricating oil composition.

Typically, the phosphate, phosphate ester, and/or the amine salt of a phosphate ester together have a phosphorus content of 2.0 wt. % or 4.0 wt. % to 10.0 wt. % or 9.0 wt. %, for example 6.9 wt. %, based on the total weight of the phosphate, the phosphate ester, and/or the amine salt of a phosphate ester.

(c) Phosphites

The phosphorus additive may alternatively or further include a phosphite, such as a mono-, a di-, or a trihydrocarbyl phosphite. Trihydrocarbyl phosphites are also referred to as phosphite esters. Examples of phosphites used in accordance with present embodiments include dihydrocarbyl hydrogen phosphites or phosphite esters.

In one embodiment, the phosphorus-containing anti-wear additive is a dihydrocarbyl hydrogen phosphite. Dihydrocarbyl hydrogen phosphites are represented by the formula (VI) below:

$$O{=}P(OR)_2H \quad \text{(VI)}$$

wherein R represents a hydrocarbon group having 1 to 30 carbons.

Specific examples of dihydrocarbyl hydrogen phosphites include aryl dihydrocarbyl hydrogen phosphites such as a diphenyl hydrogen phosphite, dicresyl hydrogen phosphite, phenyl cresyl hydrogen phosphite, a monophenyl 2-ethylhexyl hydrogen phosphite; and aliphatic dihydrocarbyl phosphites such as dibutyl hydrogen phosphite, dioctyl hydrogen phosphite, diisooctyl hydrogen phosphite, di (2-ethylhexyl) hydrogen phosphite, didecyl hydrogen phosphite, dioleyl hydrogen phosphite, dilauryl hydrogen phosphite, and distearyl hydrogen phosphite In one embodiment, the phosphorus-containing anti-wear additive is a phosphite ester. Phosphite esters are represented by the formula (VII) below:

$$P(OR)_3 \quad \text{(VII)},$$

wherein R represents a hydrocarbon group having 1 to 30 carbons. The hydrocarbon group may have one or more heteroatoms such as oxygen or sulfur. By way of example, the hydrocarbon groups may individually, in some embodiments, include ethers or thioethers. In one embodiment, the hydrocarbon groups are thioethers.

Other specific examples of trihydrocarbyl phosphites include aryl trihydrocarbyl phosphites such as a triphenyl phosphite, a tricresyl phosphite, a trisnonyl phenyl phosphite, a diphenylmono-2-ethylhexyl phosphite, and a diphenylmono tridecyl phosphite; and aliphatic trihydrocarbyl phosphites such as a tributyl phosphite, a trioctyl phosphite, a triisooctyl phosphite, a tri (2-ethylhexyl) phosphite, a trisdecyl phosphite, a tritridecyl phosphite, a trioleyl phosphite, a trilauryl phosphite, and a tristearyl phosphite.

According to example embodiments, the phosphite ester is present from 0.05 wt. %, 0.10 wt. %, or 0.20 wt. % to 1.0 wt. %, 0.7 wt. %, or 0.50 wt. %, based on the weight of the lubricating oil composition.

According to example embodiments, the phosphite ester has a phosphorus content of from 5 wt. %, 9 wt. %, or 7 wt. % to 20 wt. %, 16 wt. %, or 14 wt. %, based on the weight of the phosphite ester.

According to example embodiments, the phosphite ester is selected from a dilauryl hydrogen phosphite having 7.2 wt. % phosphorus, a diphenyl hydrogen phosphite having 13.3 wt. % phosphorus, and a phosphite ester containing thioether alkyl groups having 8 wt. % phosphorus and 8.4 wt. % sulfur, wherein the phosphorus and sulfur content are based on the weight of the phosphite ester.

The phosphorus-based additives provide phosphorus to the lubricating oil composition such that the total amount of phosphorous in the composition is 0.005 wt. %, 0.01 wt. %, 0.02 wt. %, 0.03 wt. %, or 0.04 wt. % to 0.05 wt. %, 0.1 wt. %, or 0.2 wt. %, based on the total weight of the lubricating oil composition.

Corrosion Inhibitor

The lubricating oil composition may also include a corrosion inhibitor, such as a nitrogen-containing corrosion inhibitor. The corrosion inhibitor can be a nitrogen-containing heterocyclic compound and derivatives thereof. In an example embodiment, the corrosion inhibitor is a triazole, and the triazole typically does not include any active sulfur groups. For example, the corrosion inhibitor often includes alkyl and aryl derivatives of triazoles, such as tolyltriazole. These can be substituted or unsubstituted. An example tolyltriazole compound has following formula VIII:

(VIII)

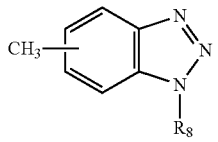

In the above formula, $R_8$ is represents a hydrogen or an alkyl group having 1 to 30 carbons. $R_8$ may be linear or branched, it may be saturated or unsaturated. It may contain ring structures that are alkyl or aromatic in nature. $R_8$ may also contain heteroatoms such as N, O or S.

The substituted triazole may be prepared by condensing a basic triazole via its acidic —NH group with an aldehyde and an amine. In some embodiments, the substituted triazole is the reaction product of a triazole, an aldehyde, and an amine. Suitable triazoles that may be used to prepare the substituted triazole of the disclosure include triazole, alkyl substituted triazole, benzotriazole, tolyltriazole, or other aryltriazoles while suitable aldehydes include formaldehyde and reactive equivalents like formalin, while suitable amines include primary or secondary amines. In some embodiments, the amines are secondary amines and further are branched amines. In still further embodiments the amines are beta branched amines, for examples bis-2-ethylhexyl amine.

In one embodiment, the substituted triazole of the present disclosure is alkyl substituted triazole. In another embodiment, the substituted triazole is benzotriazole.

According to one example embodiment, the triazole is an N-alkyl tolyltriazole containing 14.6 wt. % nitrogen, based on the total weight of the triazole.

In one embodiment, the corrosion inhibitor is present in an amount not greater than 0.1 wt. %, for example 0.01 wt. % or 0.02 wt. % to 0.05 wt. % or 0.04 wt. %, for example 0.03 wt. %, based on the weight of the total lubricating oil composition.

Dispersant

The lubricating oil composition of the present disclosure can contain one or more ashless dispersants. Generally, the ashless dispersants are boron-containing or nitrogen-containing, for example dispersants formed by reacting alkenyl succinic anhydride with an amine. Examples of such dispersants are alkenyl succinimides and succinamides. These dispersants can be further modified by reaction with, for example, ethylene carbonate. Ester-based ashless dispersants derived from long chain hydrocarbon-substituted carboxylic acids and hydroxy compounds may also be employed.

The ashless dispersants can be derived from polyisobutenyl succinic anhydride. These dispersants are commercially available. According to an example embodiment, the lubricating oil composition includes polyisobutenyl succinimide containing boron as a dispersant. The polyisobutenyl succinimide dispersant typically contains boron in an amount of 0.1 wt. % to 2 wt. % and nitrogen in an amount of 0.5 wt. % to 5 wt. %, based on the total weight of the polyisobutenyl succinimide dispersant. According to the example embodiment, the borated polyisobutenyl succinimide dispersant has an average molecular weight of 1300, nitrogen content of 1.95 wt. %, and boron content of 0.63 wt. %. The borated polyisobutenyl succinimide dispersant is typically present in an amount of 0.3 wt. % to 2.0 wt. %, based on the total weight of the lubricating oil composition. In one embodiment, the polyisobutenyl succinimide provides the lubricating oil composition with a nitrogen content of 156 ppm and boron content of 60 ppm. The borated polyisobutenyl succinic imide can provide good results when subjected to a Komatsu Hot Tube test. It is clean and suppresses the adhesion of high temperature deposits.

Other Additives

The lubricating oil composition may further include at least one additive or at least one modifier (hereinafter designated as "additive") that can impart or improve any desirable property of the lubricating oil composition. Any additive known to a person of ordinary skill in the art may be used in the lubricating oil compositions disclosed herein. Some suitable additives are described in Mortier et al., "*Chemistry and Technology of Lubricants,*" 2nd Edition, London, Springer, (1996); and Leslie R. Rudnick, "*Lubricant Additives: Chemistry and Applications*," New York, Marcel Dekker (2003), both of which are incorporated herein by reference. In some embodiments, the additive can be selected from the group consisting of antioxidants, anti-wear agents, rust inhibitors, demulsifiers, friction modifiers, multifunctional additives, viscosity index improvers, pour point depressants, foam inhibitors, metal deactivators, dispersants, corrosion inhibitors, lubricity improvers, thermal stability improvers, anti-haze additives, icing inhibitors, dyes, markers, static dissipaters, biocides, and combinations thereof. In general, the concentration of each of the additives in the lubricating oil composition, when used, may range from 0.001 wt. %, 0.01 wt. %, or 0.1 wt. % to 8 wt. %, 10 wt. %, or 15 wt. %, based on the total weight of the lubricating oil composition. Further, the total amount of the additives in the lubricating oil composition may range from 0.001 wt. %, 0.01 wt. %, or 0.1 wt. % to 8 wt. %, 10 wt. %, or 20 wt. %, based on the total weight of the lubricating oil composition.

The lubricating oil compositions disclosed herein may in some embodiments be substantially free of metals (i.e., containing less than 50 ppm of metals). The presence of polar or ionic compounds has been shown to increase the conductivity (and thereby decrease the volume resistivity) of transmission fluids in Newcomb, T., et al, "Electrical Conductivity of New and Used Automatic Transmission Fluids," SAE Int. J. Fuels Lubr. 9(3):2016, doi:10.4271/2016-01-2205. In particular, metal-containing additives such as detergents negatively impact the volume resistivity of the lubricating oil composition and therefore should be minimized, although the presence of dispersants, friction modifiers, and wear inhibitors contribute to increased conductivity of the bulk fluid as well.

The above optional additives, in addition to typically being ashless (metal-free), are chosen such that the volume resistivity of the lubricating oil composition is greater than $1.0\times10^9$ Ω·cm. A sufficiently high volume resistivity is selected to provide adequate insulating properties in the lubricating oil composition.

Optionally, the lubricating oil composition disclosed herein can further include a friction modifier (FM). A variety of friction modifiers can be used as the friction modifier contained in the lubricating oil composition of the present disclosure. Examples include various oiliness agents such as fatty acid esters, fatty acid amides, diols, amine compounds, and molybdenum compounds. Since the molybdenum-based FM is a metal-based FM, the volume resistivity may be lowered. Therefore, it may be desirable to maintain the metal content to 50 ppm or less. The friction modifier can be used singly or as a combination of friction modifiers.

Optionally, the lubricating oil composition disclosed herein can further include an antioxidant that can reduce or prevent the oxidation of the base oil. Any antioxidant known by a person of ordinary skill in the art may be used in the lubricating oil composition. Non-limiting examples of suitable antioxidants include amine-based antioxidants (e.g., alkyl diphenylamines, phenyl-α-naphthylamine, alkyl or aralkyl substituted phenyl-α-naphthylamine, alkylated p-phenylene diamines, tetramethyl-diaminodiphenylamine and the like), phenolic antioxidants (e.g., 2-tert-butylphenol, 4-methyl-2,6-di-tert-butylphenol, 2,4,6-tri-tert-butylphenol, 2,6-di-tert-butyl-p-cresol, 2,6-di-tert-butylphenol, 4,4'-methylenebis-(2,6-di-tert-butylphenol), 4,4'-thiobis(6-di-tert-butyl-o-cresol) and the like), sulfur-based antioxidants (e.g., dilauryl-3,3'-thiodipropionate, sulfurized phenolic antioxidants and the like), phosphorus-based antioxidants (e.g., phosphites and the like), zinc dithiophosphate, oil-soluble copper compounds and combinations thereof. Some suitable antioxidants have been described in Leslie R. Rudnick, "Lubricant Additives: Chemistry and Applications," New York, Marcel Dekker, Chapter 1, pages 1-28 (2003), which is incorporated herein by reference.

The lubricating oil composition disclosed herein can optionally include a pour point depressant that can lower the pour point of the lubricating oil composition. Any pour point depressant known by a person of ordinary skill in the art may be used in the lubricating oil composition. Non-limiting examples of suitable pour point depressants include polymethacrylates, alkyl acrylate polymers, alkyl methacrylate polymers, di(tetra-paraffin phenol)phthalate, condensates of tetra-paraffin phenol, condensates of a chlorinated paraffin with naphthalene and combinations thereof. In some embodiments, the pour point depressant comprises an ethylene-vinyl acetate copolymer, a condensate of chlorinated paraffin and phenol, polyalkyl styrene or the like. Some suitable pour point depressants have been described in Mortier et al., "*Chemistry and Technology of Lubricants,*" 2nd Edition, London, Springer, Chapter 6, pages 187-189 (1996); and Leslie R. Rudnick, "*Lubricant Additives: Chemistry and Applications*," New York, Marcel Dekker, Chapter 11, pages 329-354 (2003), both of which are incorporated herein by reference.

The lubricating oil composition disclosed herein can optionally include a foam inhibitor or an anti-foam that can break up foams in oils. Any foam inhibitor or anti-foam known by a person of ordinary skill in the art may be used in the lubricating oil composition. Non-limiting examples of suitable anti-foams include silicone oils or polydimethylsiloxanes, fluorosilicones, alkoxylated aliphatic acids, polyethers (e.g., polyethylene glycols), branched polyvinyl ethers, alkyl acrylate polymers, alkyl methacrylate polymers, polyalkoxyamines and combinations thereof. In some embodiments, the anti-foam comprises glycerol monostearate, polyglycol palmitate, a trialkyl monothiophosphate, an ester of sulfonated ricinoleic acid, benzoylacetone, methyl salicylate, glycerol monooleate, or glycerol dioleate. Some suitable anti-foams have been described in Mortier et al., "*Chemistry and Technology of Lubricants,*" 2nd Edition, London, Springer, In some embodiments, the lubricating oil composition may include a multifunctional additive. Some non-limiting examples of suitable multifunctional additives include sulfurized oxymolybdenum dithiocarbamate, sulfurized oxymolybdenum organophosphorodithioate, oxymolybdenum monoglyceride, oxymolybdenum diethylate amide, amine-molybdenum complex compound, and sulfur-containing molybdenum complex compound.

In certain embodiments, the lubricating oil composition may include a viscosity index improver. Some non-limiting examples of suitable viscosity index improvers include polymethacrylate type polymers, ethylene-propylene copolymers, styrene-isoprene copolymers, hydrated styrene-isoprene copolymers, polyisobutylene, and dispersant type viscosity index improvers.

In some embodiments, the lubricating oil composition may include at least a metal deactivator. Some non-limiting examples of suitable metal deactivators include disalicylidene propylenediamine, triazole derivatives, thiadiazole derivatives, and mercaptobenzimidazoles.

The additives disclosed herein may be in the form of an additive concentrate having more than one additive. The additive concentrate may comprise a suitable diluent, such as a hydrocarbon oil of suitable viscosity. Such diluent can be selected from the group consisting of natural oils (e.g., mineral oils), synthetic oils and combinations thereof. Some non-limiting examples of the mineral oils include paraffin-based oils, naphthenic-based oils, asphaltic-based oils and combinations thereof. Some non-limiting examples of the synthetic base oils include polyolefin oils (especially hydrogenated alpha-olefin oligomers), alkylated aromatic, polyalkylene oxides, aromatic ethers, and carboxylate esters (especially diester oils) and combinations thereof. In some embodiments, the diluent is a light hydrocarbon oil, both natural or synthetic. Generally, the diluent oil can have a viscosity from about 13 cSt to about 35 cSt at 40° C.

Generally, it is desired that the diluent readily solubilizes the lubricating oil soluble additive of the invention and provides an oil additive concentrate that is readily soluble in the lubricant base oil stocks. In addition, it is desired that the diluent not introduce any undesirable characteristics, including, for example, high volatility, high viscosity, and impurities such as heteroatoms, to the lubricant base oil stocks and thus, ultimately to the finished lubricant.

The present disclosure further includes an oil soluble additive concentrate composition comprising an inert diluent and from 2.0 wt. % to 90 wt. %, such as 10 wt. % to 50 wt. % based on the weight of the total concentrate, of an oil soluble additive composition according to the present invention.

According to example embodiments, the lubricating oil composition includes succinimide dispersant, friction modifier, antioxidants, seal swell agent, foam inhibitor, viscosity modifier, and diluent oil each in an amount of not greater than 20 wt. %, based on the total weight of the lubricating oil composition.

EXAMPLES

The lubricating oil compositions of the present disclosure utilize a combination of sulfur-based and phosphorus-based additives that exhibit an exceptional combination of volume resistivity, detergency, thermal and oxidative stability, wear resistance, and corrosion resistance at high temperatures.

The following examples are presented to exemplify embodiments of the disclosure but are not intended to limit the disclosure to the specific embodiments set forth. Unless indicated to the contrary, all parts and percentages are by weight. All numerical values are approximate. When numerical ranges are given, it should be understood that embodiments outside the stated ranges may still fall within the scope of the disclosure. Specific details described in each example should not be construed as necessary features of the disclosure.

For performance evaluation, inventive lubricating oil compositions and comparative lubricating oil compositions were prepared from the following components and additives. Table 1 lists each composition, including amount (wt. %) of each component.

Sulfurized olefin A (1) is a commercially available sulfurized olefin (a sulfurized isobutylene) containing 46.3 wt. % sulfur.

Sulfurized olefin B (2) is a commercially available sulfurized olefin containing 28.8 wt. % sulfur.

Sulfurized PIB (3) is a sulfurized polyisobutylene oligomer containing 20.6 wt. % sulfur which is made by reacting highly reactive polyisobutylene (HR PIB) with sulfur, as described in U.S. Pat. No. 7,414,013.

Ashless phosphorus additive A is an alkyl phosphonate containing 8.5 wt. % phosphorus.

Ashless phosphorus additive B is an amine phosphate containing 6.9 wt. % phosphorus.

Ashless phosphorus additive C is dialkyl hydrogen phosphite containing 7.2 wt. % phosphorus.

Ashless phosphorus additive D is diaryl hydrogen phosphite containing 13.3 wt. % phosphorus.

Ashless phosphorus additive E is a phosphite ester containing thioether alkyl groups containing 8 wt. % phosphorus and 8.4 wt. % sulfur.

Sulfur EP additive is an alkyl thiadiazole containing 34.0 wt. % sulfur.

Corrosion inhibitor is a N-alkyl tolyltriazole containing 14.6 wt. % nitrogen.

Dispersant is polyisobutenyl succinimide containing 1.95 wt. % nitrogen and 0.63 wt. % boron.

Other additives present in the inventive and comparative compositions are minor amounts of friction modifier, antioxidant, seal swell agent, foam inhibitor, non-dispersant PMA type viscosity modifier, and less than 1.0 wt. % diluent oil. All other additives have the same composition and the same amount of addition.

The base oil is a mixture of API Group II base oil and API Group III base oil. The base oil mixture has a kinematic viscosity at 100° C. of 3.5 to 4.5 $mm^2/s$ and a viscosity index of 135 or more.

Shell 4-Ball Wear Test

The wear performance of each lubricating oil composition was determined by a 4-ball wear scar test in accordance with ASTM D4172 under conditions of 1800 rpm, an oil temperature of 80° C., and a load of 392N for 60 minutes. After testing, the test balls were removed and the wear scars were measured. The wear scar diameters are reported in mm in Table 1. A smaller wear scar diameter is representative of better anti-wear performance of the lubricating oil composition.

Komatsu Hot Tube (KHT) Test

The Komatsu Hot Tube test is a lubrication industry bench test that was used to measure the detergency and thermal and oxidative stability of the lubricating oil compositions in accordance with the test method JPI-5S-55-99 Hot Surface Deposit Control in JASO M355-2021. Detergency and thermal and oxidative stability are performance areas that are generally accepted in the industry as being essential to satisfactory overall performance of a lubricating oil. During the test, a specified amount of test lubricating oil composition was pumped upwards through a glass tube that was placed inside an oven set at a certain temperature. Air was introduced in the oil stream before the oil entered the glass tube and flowed upward with the oil. Evaluations of the lubricating oil compositions were conducted at 250° C. The test temperature was set at 250° C. because the thermal durability of the protective coating of polyimide ester or polyamide-based enamel on the wire used in hybrid and electric vehicles is 200 to 240° C. To demonstrate differences-between certain formulations with varying amounts of dispersant, the temperature was further raised to 270° C. and the evaluation was performed—those results are shown in Table 2. The test results were determined by comparing the amount of lacquer deposited on the glass test tube to a rating scale ranging from 0.0 (very black) to 10.0 (perfectly clean). The results are reported in multiples of 0.5. In cases where the glass tubes are completely blocked with deposits, the test result is recorded as "blocked". Blockage is indicated by deposition below a 0.0 result, in which case the lacquer is very thick and dark but still allows fluid flow, although at a rate that is completely unsatisfactory for a usable oil.

Indiana Stirring Oxidation Test (ISOT)

Sulfur compounds are known to decompose at high temperatures and form acidic species that contribute to increased copper corrosion. The Indiana Stirring Oxidation Test was used to determine the high-temperature oxidative stability of the lubricating oil compositions. The test was conducted in accordance with the standard 5.16 Oxidation Stability Test of JASO M315-2015, except that the temperature was raised to 165.5° C. to make the test more stringent (the standard test oil temperature specified under JASO M315-2015 is 150° C.). Two catalyst plates (copper and steel) and a glass varnish rod were immersed in test oil, and the test oil was heated and aerated by stirring for 96 hours at 165.5° C. At the end of the heating period, the copper content of the test oils were measured by ICP. A lower copper (Cu) content indicates lower corrosivity and thus greater oxidative stability of the sulfur compounds. Conversely, a high Cu content indicates increased formation of acidic species resulting from decomposition of sulfur additives under these conditions. Copper content is reported in parts per million (ppm) in Table 1.

Volume Resistivity

The electrical insulating ability of the lubricating oil compositions was determined by a volume resistivity test in accordance with the test method JIS C2101-1999-24. The volume resistivity of the lubricating oil compositions was measured for the newly formulated lubricating oil compositions (shown as "newly formulated oil") and then 96 hours after the ISOT test for each of the compositions (shown as "after 96 hrs"). As described above, the volume resistivity of the test lubricating oil compositions at 80° C. and an applied voltage of 250V was measured and is reported in units of Ω·cm in Table 1.

TABLE 1

| Component | Comp. Ex. 1 | Comp. Ex. 2 | Comp. Ex. 3 | Comp. Ex. 4 | Comp. Ex. 5 | Ex. 1 | Ex. 2 |
|---|---|---|---|---|---|---|---|
| Sulfurized olefin A (1) | 0.06 | | | | | | |
| Sulfurized olefin B (2) | | 0.11 | | | | | |
| Sulfurized PIB (3) | | | 0.15 | 0.15 | 0.15 | 0.15 | 0.15 |
| Ashless phosphorus additive A | 0.60 | 0.30 | 0.30 | | | 0.30 | |
| Ashless phosphorus additive B | | | | 0.37 | | | 0.37 |
| Ashless phosphorus additive C | | | | | 0.35 | | |
| Ashless | | | | | | | |

TABLE 1-continued

| | | | | | | | |
|---|---|---|---|---|---|---|---|
| phosphorus additive D | | | | | | | |
| Ashless phosphorus additive E | | | | | | | |
| Sulfur EP additive | | | | | | 0.20 | 0.20 |
| Corrosion Inhibitor | | | | | | 0.03 | 0.03 |
| Dispersant | 0.80 | 0.80 | 0.80 | 0.80 | 0.80 | 0.80 | 0.80 |
| Other additives | 5.00 | 5.00 | 5.00 | 5.00 | 5.00 | 5.00 | 5.00 |
| Base oil | Balance | Balance | Balance | Balance | Balance | Balance | Balance |
| Total, wt. % | 100 | 100 | 100 | 100 | 100 | 100 | 100 |
| Sulfur from (3) | 0.0 | 0.0 | 0.031 | 0.031 | 0.031 | 0.031 | 0.031 |
| Sulfur from EP additive | 0.0 | 0.0 | 0.0 | 0.0 | 0.0 | 0.068 | 0.068 |
| Phosphorus content | 0.051 | 0.033 | 0.029 | 0.025 | 0.026 | 0.027 | 0.024 |
| Volume Resistivity @ 80 C. ($x10^9$ Ω · cm) newly formulated oil | 8.7 | 10 | 6.0 | 6.3 | 5.5 | 6.6 | 8.1 |
| Shell 4-ball wear diameter (mm) @ 1800 rpm | 1.69 | 1.71 | 1.82 | 1.75 | 1.85 | 0.62 | 0.59 |
| KHT Deposit test Merit Rating @ 250 C. | 9.0 | 5.5 | 5.5 | 3.5 | 5.0 | 8.0 | 8.0 |
| Volume Resistivity @ 80 C. ($x10^9$ Ω · cm) after 96 hrs | 2.4 | Sludge generation | 2.8 | 2.5 | 2.0 | 1.9 | 2.3 |
| ISOT Cu (ppm) after 96 hrs | 309 | 421 | 62 | 45 | 71 | 12 | 7 |

| Component | Ex. 3 | Ex. 4 | Ex. 5 | Ex. 6 | Ex. 7 | Ex. 8 | Ex. 9 |
|---|---|---|---|---|---|---|---|
| Sulfurized olefin A (1) | | | | | | | |
| Sulfurized olefin B (2) | | | | | | | |
| Sulfurized PIB (3) | 0.15 | 0.33 | 0.50 | 0.15 | 0.15 | 0.15 | 0.15 |
| Ashless phosphorus additive A | | | | | | | |
| Ashless phosphorus additive B | | | | | | | |
| Ashless phosphorus additive C | 0.35 | 0.35 | 0.35 | 0.35 | | | |
| Ashless phosphorus additive D | | | | | 0.35 | | 0.18 |
| Ashless phosphorus additive E | | | | | | 0.25 | 0.25 |
| Sulfur EP additive | 0.20 | 0.20 | 0.10 | 0.30 | 0.20 | 0.20 | 0.20 |
| Corrosion Inhibitor | 0.03 | 0.03 | 0.03 | 0.03 | 0.03 | 0.03 | 0.03 |
| Dispersant | 0.80 | 0.80 | 0.80 | 0.80 | 0.80 | 0.80 | 0.80 |

TABLE 1-continued

| | | | | | | | |
|---|---|---|---|---|---|---|---|
| Other additives | 5.00 | 5.00 | 5.00 | 5.00 | 5.00 | 5.00 | 5.00 |
| Base oil | Balance | Balance | Balance | Balance | Balance | Balance | Balance |
| Total, wt. % | 100 | 100 | 100 | 100 | 100 | 100 | 100 |
| Sulfur from (3) | 0.031 | 0.068 | 0.102 | 0.031 | 0.031 | 0.031 | 0.031 |
| Sulfur from EP additive | 0.068 | 0.068 | 0.034 | 0.102 | 0.068 | 0.068 | 0.068 |
| Phosphorus content | 0.026 | 0.025 | 0.026 | 0.026 | 0.44 | 0.026 | 0.049 |
| Volume Resistivity @ 80 C. ($x10^9$ Ω · cm) newly formulated oil | 5.7 | 5.1 | 5.8 | 6.1 | 2.5 | 3.2 | 2.4 |
| Shell 4-ball wear diameter (mm) @ 1800 rpm | 0.66 | 0.64 | 0.65 | 0.66 | 0.60 | 0.54 | 0.59 |
| KHT Deposit test Merit Rating @ 250 C. | 8.0 | 8.0 | 8.5 | 8.0 | 9.0 | 9.0 | 8.0 |
| Volume Resistivity @ 80 C. ($x10^9$ Ω · cm) after 96 hrs | 1.8 | 1.8 | 2.2 | 2.7 | 3.9 | 2.7 | 3.8 |
| ISOT Cu (ppm) after 96 hrs | 7 | 18 | 95 | 10 | 10 | 5 | 10 |

Evaluation of the Test Lubricating Oil Compositions in Table 1

As shown by the results in Table 1, the inventive example lubricating oil compositions 1-9 exhibit an exceptional combination of volume resistivity, detergency, thermal stability, oxidative stability, wear resistance, and corrosion resistance at high temperatures.

Comparative example compositions 3-5 containing sulfurized PIB exhibit reduced corrosion relative to comparative example compositions 1 and 2, which contain conventional sulfurized olefins. As shown by the inventive examples, the addition of corrosion inhibitor further reduces the copper corrosion levels. Moreover, as demonstrated by the inventive examples, the combination of thiadiazole and sulfurized PIB, when used at levels that provide a sulfur content ranging from 0.01 wt. % to 0.2 wt. %, based on the total weight of the lubricating oil composition, provides improved wear performance over the comparative examples which do not include the combination.

TABLE 2

| Component | Ex. 1 | Comp. Ex. 6 | Ex. 3 | Comp. Ex. 7 | Ex. 10 | Ex. 8 | Comp. Ex. 8 | Ex. 11 |
|---|---|---|---|---|---|---|---|---|
| Sulfurized PIB (3) | 0.15 | 0.15 | 0.15 | 0.15 | 0.15 | 0.15 | 0.15 | 0.15 |
| Ashless phosphorus additive A | 0.30 | 0.30 | | | | | | |
| Ashless phosphorus additive B | | | | | | | | |
| Ashless phosphorus additive C | | | 0.35 | 0.35 | 0.35 | | | |
| Ashless phosphorus additive D | | | | | | | | |
| Ashless phosphorus additive E | | | | | | 0.25 | 0.25 | 0.25 |
| Sulfur EP additive | 0.20 | 0.20 | 0.20 | 0.20 | 0.20 | 0.20 | 0.20 | 0.20 |
| Corrosion Inhibitor | 0.03 | 0.03 | 0.03 | 0.03 | 0.03 | 0.03 | 0.03 | 0.03 |
| Dispersant | 0.80 | 0.00 | 0.80 | 0.00 | 1.60 | 0.80 | 0.00 | 1.60 |
| Other additives | 5.00 | 5.00 | 5.00 | 5.00 | 5.00 | 5.00 | 5.00 | 5.00 |
| Base oil | Balance | Balance | Balance | Balance | Balance | Balance | Balance | Balance |
| Total, wt. % | 100 | 100 | 100 | 100 | 100 | 100 | 100 | 100 |
| Sulfur from (3) | 0.031 | 0.031 | 0.031 | 0.031 | 0.031 | 0.031 | 0.031 | 0.031 |
| Sulfur from EP additive | 0.068 | 0.10 | 0.068 | 0.068 | 0.068 | 0.068 | 0.068 | 0.068 |
| Phosphorus content | 0.027 | 0.027 | 0.026 | 0.026 | 0.026 | 0.026 | | |
| Volume Resistivity @ 80 C. ($x10^9$ Ω · cm) newly formulaled oil | 6.6 | | 5.7 | | | 3.2 | | |

TABLE 2-continued

| Component | Ex. 1 | Comp. Ex. 6 | Ex. 3 | Comp. Ex. 7 | Ex. 10 | Ex. 8 | Comp. Ex. 8 | Ex. 11 |
|---|---|---|---|---|---|---|---|---|
| KHT Deposit test Merit Rating @ 250 C. | 8.0 | 6.0 | 8.0 | 5.0 | 9.0 | 9.0 | 4.0 | 9.0 |
| KHT Deposit test Merit Rating @ 270 C. | 4.0 | Blocked | 4.0 | 0.0 | 5.5 | 4.0 | 0.0 | 5.5 |
| Volume Resistivity @ 80 C. ($x10^9$ Ω · cm) after 96 hrs | 1.9 | Sludge | 1.8 | Sludge | 1.1 | 2.7 | Sludge | 1.3 |
| Sludge or Varnish Formation (ISOT) | None | Sludge | None | Sludge | None | None | Sludge | None |

Evaluation of the Test Lubricating Oil Compositions in Table 2

Table 2 shows the results from various compositions where the amount of borated succinimide dispersant was varied from 0.0 wt. % (not added) to double the amounts shown in Table 1 (1.6 wt. %). As shown in Table 2, Comparative Example 6 has the same composition as Example 1, but with no dispersant. Likewise for Comparative Example 7 and Example 3; as well as Comparative Example 8 and Example 8. As shown in the table, the KHT test results are significantly worse for the Comparative Examples, which do not include dispersant. Additionally, sludge is generated when testing these compositions in accordance with ISOT (JASO M315-15, ATF 5.16: Thermal & Oxidation Stability Test, oil temperature 165.5° C., 96 hours). In contrast, the inventive compositions with the borated dispersant do not generate lacquer (sludge).

Examples 10 and 11 include double the amount of dispersant compared to Examples 3 and 8, respectively. As shown in Table 2, KHT results are better for the compositions having more dispersant, particularly at higher temperatures.

These results are believed to demonstrate that if, during use, the lubricating oil deteriorates due to oxidative use, sludge will be formed inside the coil of the enamel wire in the electromagnet inside the motor and inside the transmission, which can cause a failure. Notably, the increase in TAN and the rate of increase in kinematic viscosity at 40° C. (ISOT evaluation parameters) of test oils Ex. 1 to Ex. 11 shown in Tables 1 and 2 are all less than 2.0 mg KOH/g and less than 5%, respectively, further demonstrating good levels of oxidation and thermal stability.

Additional Description

The following non-limiting clauses are offered as additional description of various example embodiments of the present invention.

Embodiment 1. A lubricating oil composition for an automotive vehicle with an electric motor and/or generator, comprising: a. a major amount of an oil of lubricating viscosity having a kinematic viscosity at 100° C. in a range of about 1.5 $mm^2/s$ to about 20 $mm^2/s$; b. a sulfur-based additive including a thiadiazole and a sulfurized polyolefin of formula (I):

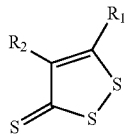

(I)

where $R_1$ is hydrogen or methyl, and $R_2$ is a C8-C40 hydrocarbyl group, the sulfur-based additive providing sulfur to the lubricating oil composition in an amount of 0.01 wt. % to 0.2 wt. %, based on the total weight of the lubricating oil composition; c. a phosphorus compound; and d. an ashless polyisobutenyl succinimide-based dispersant containing boron.

Embodiment 2. The lubricating oil composition of embodiment 1, wherein the sulfurized polyolefin of formula (I) provides the lubricating oil composition with a sulfur content of 0.01 wt. % to 0.2 wt. %, based on the total weight of the lubricating oil composition.

Embodiment 3. The lubricating oil composition of any preceding embodiment, wherein the thiadiazole provides the lubricating oil composition with a sulfur content of 0.005 wt. % to 0.2 wt. %, based on the total weight of the lubricating oil composition.

Embodiment 4. The lubricating oil composition of any preceding embodiment including sulfur in a total amount of 0.01 wt. % to 0.2 wt. %, based on the total weight of the lubricating oil composition.

Embodiment 5. The lubricating oil composition of any preceding embodiment, wherein the lubricating oil composition contains less than 50 ppm of metals and has a volume resistivity greater than $1.0\times10^9$ Ω·cm at 80° C.

Embodiment 6. The lubricating oil composition of any preceding embodiment, wherein the phosphorus compound includes at least one of a phosphate, a phosphate ester, an amine salt of a phosphate ester, a phosphonate a phosphonate ester, a phosphite, and a phosphite ester.

Embodiment 7. The lubricating oil composition of any preceding embodiment including phosphorus in a total amount of 0.005 wt. % to 0.2 wt. %, based on the total weight of the lubricating oil composition.

Embodiment 8. The lubricating oil composition of any preceding embodiment, wherein the ashless polyisobutenyl succinimide-based dispersant includes boron in an amount of 0.003 wt. % to 0.02 wt. %, based on the total weight of the ashless polyisobutenyl succinimide-based dispersant.

Embodiment 9. The lubricating oil composition of any preceding embodiment including a corrosion inhibitor containing nitrogen.

Embodiment 10. The lubricating oil composition of any preceding embodiment, wherein the oil of lubricating viscosity includes a Group II base stock and a Group III base stock.

Embodiment 11. The lubricating oil composition of any preceding embodiment, wherein the sulfurized polyolefin of formula I is a sulfurized polyisobutylene oligomer of formula II:

(II)

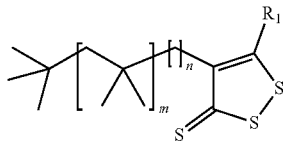

wherein R1 is hydrogen or methyl, m is an integer from 1 to 9, and n is 0 or 1.

Embodiment 12. A method of reducing corrosion and improving wear protection in the transmission system of an automotive vehicle with an electric motor and/or generator by lubricating the transmission system with a lubricating oil composition, the lubricating oil composition comprising: a. a major amount of an oil of lubricating viscosity having a kinematic viscosity at 100° C. in a range of about 1.5 $mm^2/s$ to about 20 $mm^2/s$; b. an sulfur-based additive including a thiadiazole and a sulfurized polyolefin of formula (I):

(I)

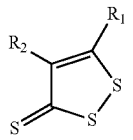

where $R_1$ is hydrogen or methyl, and $R_2$ is a C8-C40 hydrocarbyl group, the sulfur-based additive providing sulfur to the lubricating oil composition in an amount of 0.01 wt. % to 0.2 wt. %, based on the total weight of the lubricating oil composition; c. a phosphorus compound; and d. an ashless polyisobutenyl succinimide-based dispersant containing boron.

Embodiment 13. The method of embodiment 11, wherein the sulfur-based additive consists of the thiadiazole and the sulfurized polyolefin of formula (I).

Embodiment 14. The method of any preceding embodiment, wherein the sulfurized polyolefin of formula (I) provides the lubricating oil composition with a sulfur content of 0.01 wt. % to 0.2 wt. %, based on the total weight of the lubricating oil composition.

Embodiment 15. The method of any preceding embodiment, wherein the thiadiazole provides the lubricating oil composition with a sulfur content of 0.005 wt. % to 0.2 wt. %, based on the total weight of the lubricating oil composition.

Embodiment 16. The method of any preceding embodiment, wherein the lubricating oil composition includes sulfur in a total amount of 0.01 wt. % to 0.2 wt. %, based on the total weight of the lubricating oil composition.

Embodiment 17. The method of any preceding embodiment, wherein the lubricating oil composition contains less than 50 ppm of metals and has a volume resistivity greater than $1.0\times10^9$ Ω·cm at 80° C.

Embodiment 18. The method of any preceding embodiment, wherein the phosphorus compound includes at least one of a phosphate, a phosphate ester, an amine salt of a phosphate ester, a phosphonate a phosphonate ester, a phosphite, and a phosphite ester.

Embodiment 19. The method of any preceding embodiment, wherein the lubricating oil composition includes phosphorus in a total amount of 0.005 wt. % to 0.2 wt. %, based on the total weight of the lubricating oil composition.

Embodiment 20. The method of any preceding embodiment, wherein the ashless polyisobutenyl succinimide-based dispersant includes boron in an amount of 0.003 wt. % to 0.02 wt. %, based on the total weight of the ashless polyisobutenyl succinimide-based dispersant.

Embodiment 21. The method of any preceding embodiment, wherein the lubricating oil composition includes a corrosion inhibitor containing nitrogen; and the oil of lubricating viscosity includes a Group II base stock and a Group III base stock.

It will be understood that various modifications may be made to the embodiments disclosed herein. Therefore, the above description should not be construed as limiting, but merely as exemplifications of example embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A lubricating oil composition for an automotive vehicle with an electric motor and/or generator, comprising:

a. a major amount of an oil of lubricating viscosity having a kinematic viscosity at 100° C. in a range of about 1.5 $mm^2/s$ to about 20 $mm^2/s$;

b. a thiadiazole and a sulfurized polyolefin of formula (I):

(I)

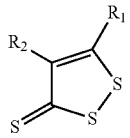

where $R_1$ is hydrogen or methyl, and $R_2$ is a C8-C40 hydrocarbyl group, the sulfur-based additive providing sulfur to the lubricating oil composition in an amount of 0.01 wt. % to 0.2 wt. %, based on the total weight of the lubricating oil composition;

c. a phosphorus compound; and d. an ashless polyisobutenyl succinimide-based dispersant containing boron present in an amount of 0.3 wt. % to 2.0 wt. % based on the total weight of the lubricating oil composition.

2. The lubricating oil composition of claim 1, wherein the sulfurized polyolefin of formula (I) provides the lubricating oil composition with a sulfur content of 0.01 wt. % to 0.2 wt. %, based on the total weight of the lubricating oil composition.

3. The lubricating oil composition of claim 1, wherein the thiadiazole provides the lubricating oil composition with a sulfur content of 0.005 wt. % to 0.2 wt. %, based on the total weight of the lubricating oil composition.

4. The lubricating oil composition of claim 1 including sulfur in a total amount of 0.01 wt. % to 0.2 wt. %, based on the total weight of the lubricating oil composition.

5. The lubricating oil composition of claim 1, wherein the lubricating oil composition contains less than 50 ppm of metals and has a volume resistivity greater than $1.0\times10^9$ Ω·cm at 80° C.

6. The lubricating oil composition of claim 1, wherein the phosphorus compound includes at least one of a phosphate, a phosphate ester, an amine salt of a phosphate ester, a phosphonate a phosphonate ester, a phosphite, and a phosphite ester.

7. The lubricating oil composition of claim 1 including phosphorus in a total amount of 0.005 wt. % to 0.2 wt. %, based on the total weight of the lubricating oil composition.

8. The lubricating oil composition of claim 1 including a triazole-containing corrosion inhibitor.

9. The lubricating oil composition of claim 1, wherein the oil of lubricating viscosity includes a Group II base stock and a Group III base stock.

10. The lubricating oil composition of claim 1, wherein the sulfurized polyolefin of formula I is a sulfurized polyisobutylene oligomer of formula II:

(II)

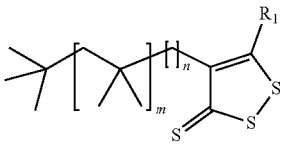

wherein R1 is hydrogen or methyl, m is an integer from 1 to 9, and n is 0 or 1.

11. A method of reducing corrosion and improving wear protection in the transmission system of an automotive vehicle with an electric motor and/or generator by lubricating the transmission system with a lubricating oil composition, the lubricating oil composition comprising:

a. a major amount of an oil of lubricating viscosity having a kinematic viscosity at 100° C. in a range of about 1.5 $mm^2/s$ to about 20 $mm^2/s$;

b. a thiadiazole and a sulfurized polyolefin of formula (I):

(I)

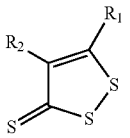

where R1 is hydrogen or methyl, and R2 is a C8-C40 hydrocarbyl group, the sulfur-based additive providing sulfur to the lubricating oil composition in an amount of 0.01 wt. % to 0.2 wt. %, based on the total weight of the lubricating oil composition;

c. a phosphorus compound; and d. an ashless polyisobutenyl succinimide-based dispersant containing boron present in an amount of 0.3 wt. % to 2.0 wt. % based on the total weight of the lubricating oil composition.

12. The method of claim 11, wherein the sulfur-based additive consists of the thiadiazole and the sulfurized polyolefin of formula (I).

13. The method of claim 11, wherein the sulfurized polyolefin of formula (I) provides the lubricating oil composition with a sulfur content of 0.01 wt. % to 0.2 wt. %, based on the total weight of the lubricating oil composition.

14. The method of claim 11, wherein the thiadiazole provides the lubricating oil composition with a sulfur content of 0.005 wt. % to 0.2 wt. %, based on the total weight of the lubricating oil composition.

15. The method of claim 11, wherein the lubricating oil composition includes sulfur in a total amount of 0.01 wt. % to 0.2 wt. %, based on the total weight of the lubricating oil composition.

16. The method of claim 11, wherein the lubricating oil composition contains less than 50 ppm of metals and has a volume resistivity greater than $1.0\times10^9$ Ω·cm at 80° C.

17. The method of claim 11, wherein the phosphorus compound includes at least one of a phosphate, a phosphate ester, an amine salt of a phosphate ester, a phosphonate a phosphonate ester, a phosphite, and a phosphite ester.

18. The method of claim 11, wherein the lubricating oil composition includes phosphorus in a total amount of 0.005 wt. % to 0.2 wt. %, based on the total weight of the lubricating oil composition.

19. The method of claim 11, wherein the lubricating oil composition includes a corrosion inhibitor containing nitrogen, and the oil of lubricating viscosity includes a Group II base stock and a Group III base stock.

20. The method of claim 11, wherein the lubricating oil composition includes a corrosion inhibitor comprising a tolyltriazole derivative, and wherein the oil of lubricating viscosity includes a Group II base stock and a Group III base stock.

21. The method of claim 11, wherein the lubricating oil composition comprises a corrosion inhibitor comprising a tolyltriazole derivative with an alkyl amine moiety, and wherein the oil of lubricating viscosity includes a Group II base stock and a Group III base stocks.

* * * * *